US006667571B2

(12) United States Patent
Shimizu et al.

(10) Patent No.: US 6,667,571 B2
(45) Date of Patent: Dec. 23, 2003

(54) FLUORESCENT LUMINOUS TUBE AND METHOD OF MANUFACTURING THE SAME

(75) Inventors: Yukihiko Shimizu, Mobara (JP); Masao Saito, Mobara (JP)

(73) Assignee: Futaba Corporation, Mobara (JP)

( * ) Notice: Subject to any disclaimer, the term of this patent is extended or adjusted under 35 U.S.C. 154(b) by 0 days.

(21) Appl. No.: 10/113,289

(22) Filed: Apr. 2, 2002

(65) Prior Publication Data

US 2002/0140345 A1 Oct. 3, 2002

(30) Foreign Application Priority Data

Apr. 3, 2001 (JP) ..... 2001-104743

(51) Int. Cl.[7] ..... H01J 63/04
(52) U.S. Cl. ..... 313/496; 313/495; 313/631
(58) Field of Search ..... 313/495, 496, 313/492, 631

*Primary Examiner*—Vip Patel
(74) *Attorney, Agent, or Firm*—Oblon, Spivak, McClelland, Maier & Neustadt, P.C.

(57) ABSTRACT

A high-resolution fluorescent luminous tube is provided wherein no light leaks from the gap between electrodes and fluorescent substance layers are formed with high precision. The fluorescent luminous tube includes anode conductors 3 and bars of a grid 8, arranged over an inner surface of a translucent insulating substrate 1 and spaced apart from one another, the anode conductors each having an opening which exposes the substrate, and a fluorescent substance layer 5 formed in the opening. Light emission of the fluorescent substance layer caused by impingement of electrons emitted from a cathode is observed from the outside of the substrate via the opening. The lightproof insulating layer 12 is formed in the gap between each anode conductor and each bar of the grid. The lightproof insulating layer 12 can block light emission leaking to the front surface through the gap between an anode conductor and a bar of the grid formed on the substrate, thus improving the display contrast. The fluorescent substance layer can be formed inside the opening in an anode conductor by coating a photosensitive fluorescent substance paste all over the surface of a substrate and then exposing it to light through the outer surface of the substrate. This approach can provide a more-simplified process with higher precision, compared with the conventional method where a fluorescent substance paste is coated only in the opening by means of a mask.

8 Claims, 4 Drawing Sheets

FLUORESCENT LUMINOUS TUBE AND METHOD OF MANUFACTURING THE SAME

BACKGROUND OF THE INVENTION

The present invention relates to a fluorescent luminous tube useful as a write element such as an optical print head, and to a method of manufacturing the same.

FIG. 5 is a cross-sectional view illustrating a fluorescent luminous tube acting as a write element for an optical print head, proposed by the present inventor. FIG. 6 is a perspective view partially illustrating the configuration inside the housing in FIG. 5.

The fluorescent luminous tube has a housing formed of a box-like container 2 (with an open lower end) for hermetically sealing the upper surface of a translucent insulating substrate 1. Anodes and bars of a grid are two-dimensionally disposed on the upper surface of the substrate 1 at intervals. Each anode is isolated from each grid bar.

A number of strip-shaped anode conductors 3 (led out from the container and each acting as an anode wire being a power feed terminal) are formed on an inner surface of the substrate 1. Anode conductors 3 are arranged in parallel and at predetermined intervals and are arranged in the direction (in the secondary scanning direction of an optical print head) perpendicular to the longitudinal direction thereof (to the primary scanning direction of an optical print head). A square opening 4, through which the substrate 1 is exposed, is formed at the front end of each anode conductor 3. A fluorescent substance layer 5 is formed in the opening 4. As shown in FIG. 6, two groups of anode conductors 3 placed in the primary direction are arranged in the secondary scanning direction at predetermined intervals. The two groups of anode conductors are shifted from each other in the primary scanning direction by one-half the pitch at which luminous dots are arranged. Two columns of a large number of square luminous dots (fluorescent substance dots) defined in the openings 4, which are arranged at predetermined intervals in the primary scanning direction, are observed from the outside of the substrate 1. In other words, the luminous dots are arranged in zigzag form. The respective anode conductors 3 are led out from the container and are connected to the drive element (IC) 7 mounted on the drive circuit substrate 6.

On the inner surface of the substrate 1, the bars of the flat grid 8 are placed between anode conductors 3 and so as to spaced apart from the anode conductors 3. The bars of the grid 8 are integrally formed electrically and are placed in the gaps between the plural stripe-shaped anode conductors 3 arranged in parallel. The grid 8 has a comb-like structure.

Cathodes 9 each acting as an electron source, as shown in FIG. 5, are disposed inside the container. Shield electrodes 10 are placed inside the container in such a way that a reactive current does not flow to various conductors formed on the substrate 1. A NESA film 11 is formed on the inner surface of the rear plate of the container 2, confronting the substrate 1.

In the above-mentioned structure, electrons emitted from the cathode 9 collide with the fluorescent substance layer 5, thus emitting light. The light emission of the fluorescent substance layer 5 is observed, as a predetermined dot defined by the opening 4, from the outer surface of the substrate 1. When an optical write object and a fluorescent print head are relatively moved in the secondary direction, light beams emitted from two columns of luminous dots arranged in zigzag form can form a single line continuing in the primary scanning direction on the optical write object. In order to draw an image on an optical write object, the fluorescent print head is first suitably driven in accordance with drive information created from image information. Then, the fluorescent print head and an optical write object (not shown) formed of a silver salt paste are relatively moved in synchronous with the drive operation.

However, in conventional fluorescent luminous tube, part of light beams radiated toward the rear surface (the NESA film 11) from the fluorescent substance layers 5 backs to the front surface (the observer side) due to irregular reflection. The backed light leaks to the front side through the gap between the anode conductor 3 and the bar of the grid 8, thus resulting in a low contrast.

Moreover, because the fluorescent substance layer 5 is formed using the photolithography, the openings 4 in anode conductors 3 have to be aligned with the photo mask with high precision. Alignment with low precision results in the fluorescent substance coated at the position displaced from the anode conductor 3 on the substrate 1. That fluorescent substance light-emits in drive operation and is observed as a minute luminous point. Such a defective (NG) element cannot be used as a write element. For that reason, the realizable resolution of the conventional fluorescent luminous tube is limited to 300 dpi.

SUMMARY OF THE INVENTION

The present invention is made to solve the above-mentioned problems.

An object of the invention is to provide a fluorescent luminous tube wherein the light leaking from the gap between an anode conductor and bars of a grid is blocked so as to obtain a high contrast. Another object of the present invention is to provide a method of manufacturing a fluorescent luminous tube with high resolution, without accurately aligning anode conductors with a mask in a fluorescent substance layer fabrication step.

The objective of the present invention is achieved by a fluorescent luminous tube comprising anode conductors (3) and bars of a grid (8), each being arranged over an inner surface of a translucent substrate (1) and spaced apart from one another, the anode conductors each having an opening (4) which exposes the substrate; a fluorescent substance layer (5) formed in the opening; a housing (2) for sealing the inner surface of the substrate; an electron source (cathode 9) disposed inside the housing; and a lightproof insulating layer (12) formed in the gap between each anode conductor and each bar of the grid.

According to another aspect of the present invention, a fluorescent luminous tube comprises a translucent substrate (1); a plurality of anode conductors (3) arranged over an inner surface of the substrate at predetermined intervals, each of the anode conductors having an opening which exposes the substrate; a fluorescent substance layer (5) formed in the opening; a grid (8) arranged over the inner surface of the substrate, bars of the grid being disposed between the anode conductors and spaced apart from the anode conductors; a housing (2) for sealing the inner surface of the substrate; and an electron source (cathode 9) disposed inside the housing. This structure further includes a plurality of luminous dots where luminous substance layers each defined by the opening are arranged at the predetermined intervals, viewed from the outer surface of the substrate. Moreover, a lightproof insulating layer (12) is formed on the inner surface of the substrate so as to bury the gap between each anode conductor and each bar of the grid.

In the fluorescent luminous tube, the thickness of the lightproof insulating layer (12) does not exceed the thickness of a fluorescent substance layer (5).

In the fluorescent luminous tube, light emission of the fluorescent substance layer (5), which results from impingement of electrons emitted from the electron source (cathode 9), is observed from the side of the substrate via said opening (4) and the substrate (1), or light emission of each luminous dot, which results from impingement of electrons emitted from the electron source, is illuminated out from the substrate via the opening and the substrate.

Moreover, in a method of manufacturing a fluorescent luminous tube, according to the present invention, first, a plurality of anode conductors is formed on an inner surface of a translucent substrate (1) at intervals, each of the plurality of anode conductors (3) having an opening (4) which exposes the substrate. Next, a photosensitive resist (18) is coated all over the inner surface of the substrate. The photosensitive resist is light exposed via a mask, the mask being disposed so as to confront the inner surface of the substrate. Thus, a lightproof film is formed only the inside of the opening. Next, a photosensitive lightproof fluorescent insulating material (photosensitive black matrix 20) is coated all over the inner surface of the substrate. The entire outer surface of the substrate is light exposed. The lightproof film in the opening is removed while a lightproof insulating film (12) is formed only on the substrate between the anode conductors. Next, a photosensitive fluorescent substance (fluorescent substance paste 21) is coated in the inner surface of the substrate to at least the opening and the substrate is light exposed. Then, a fluorescent substance layer (5) is formed.

BRIEF DESCRIPTION OF THE DRAWINGS

This and other objects, features, and advantages of the present invention will become more apparent upon a reading of the following detailed description and drawings, in which.

DETAILED DESCRIPTION OF THE PREFERRED EMBODIMENTS

Figure 5:
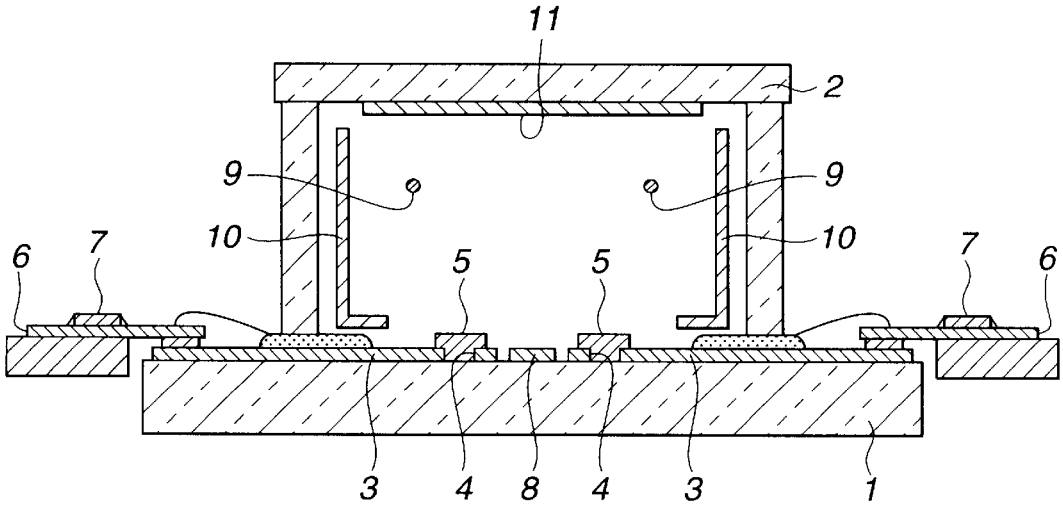
FIG. 5 is a cross-sectional view partially illustrating a conventional fluorescent luminous tube taken along the line A—A in FIG. 6.
Figure 6:
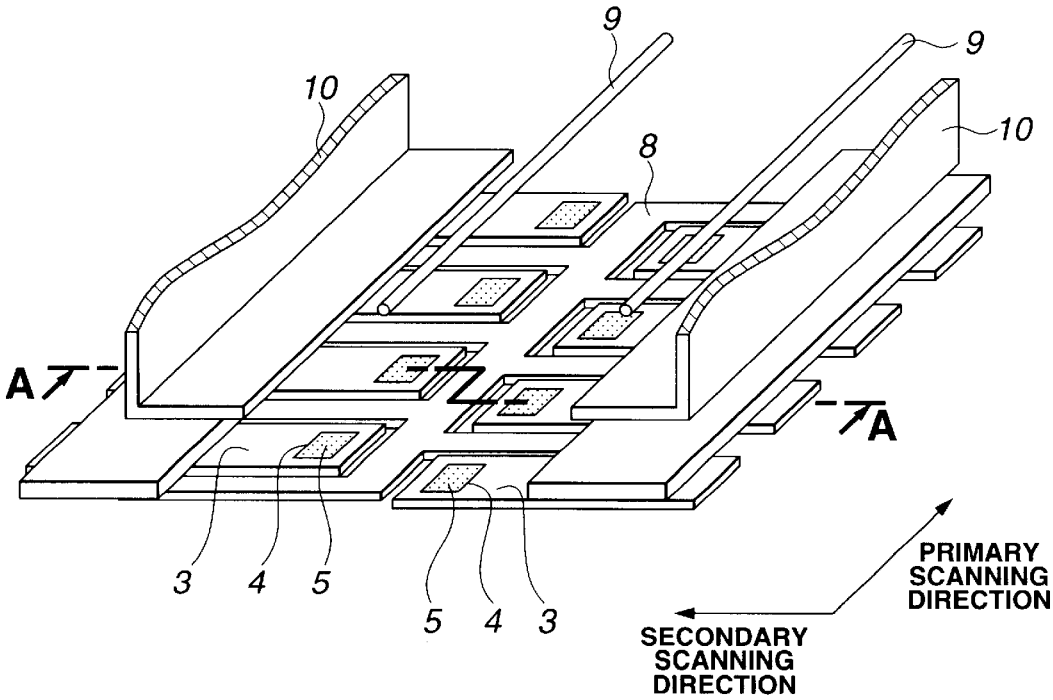
FIG. 6 is a perspective view illustrating the main portion of the conventional fluorescent luminous tube.

The configuration of a fluorescent luminous tube according to a first embodiment of the present invention will be described below with reference to FIGS. 1 and 2. This fluorescent luminous tube has a large number of luminous dots used as a light source for a printer. In this embodiment, the structure of the container and the anode conductors 3 and the grid 8 formed on the substrate 1 are similar those in the conventional fluorescent luminous tube (FIGS. 5 and 6). The common elements are not reviewed here in detail to avoid the duplicate description. Hence, novel elements and processes will be mainly described below.

Figure 1:
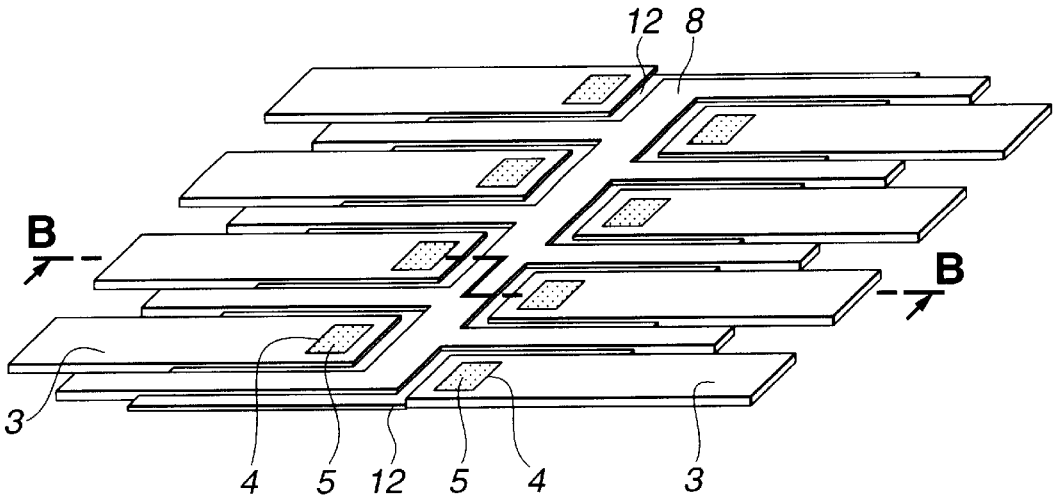
FIG. 1 is a perspective view partially illustrating a fluorescent luminous tube according to an embodiment of the present invention.
Figure 2:
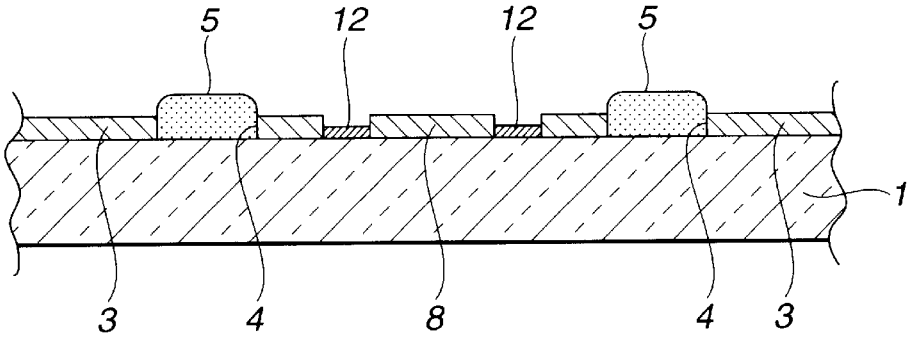
FIG. 2 is a cross-sectional view illustrating the main portion of the fluorescent display tube taken along the line B—B in FIG. 1, according to the embodiment of the present invention.
Figure 3A:
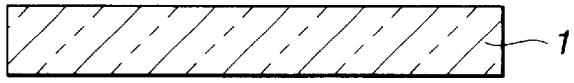
FIG. 3 is a diagram illustrating the first half of the manufacturing process, according to the embodiment of the present invention.
Figure 3B:
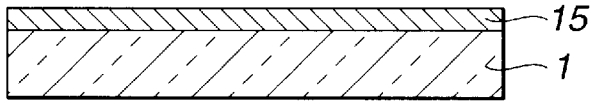
Figure 3C:
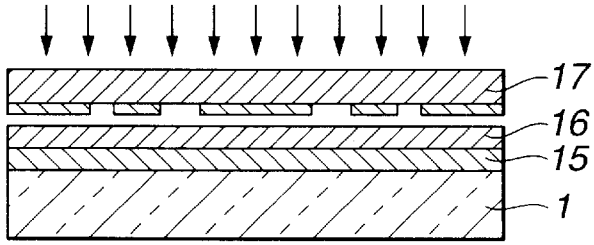
Figure 3D:
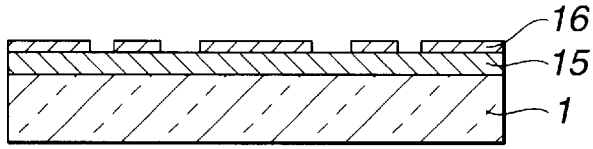
Figure 3E:
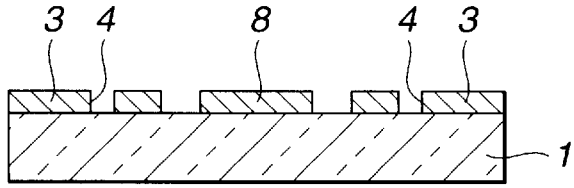
Figure 4A:
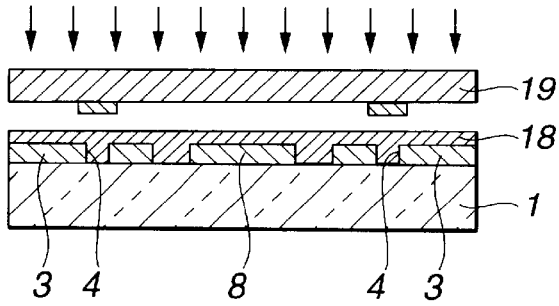
FIG. 4 is a diagram illustrating the second half of the manufacturing process, according to the embodiment of the present invention.
Figure 4B:
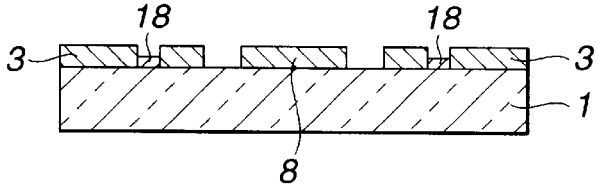
Figure 4C:
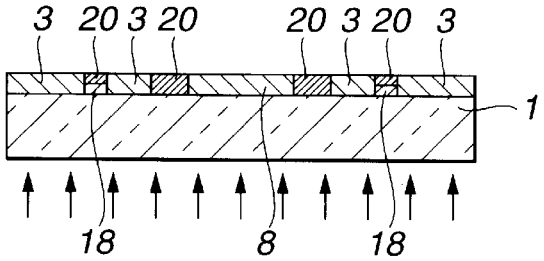
Figure 4D:
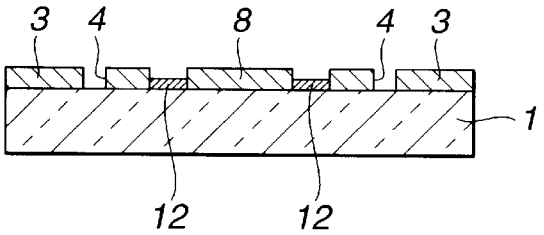
Figure 4E:
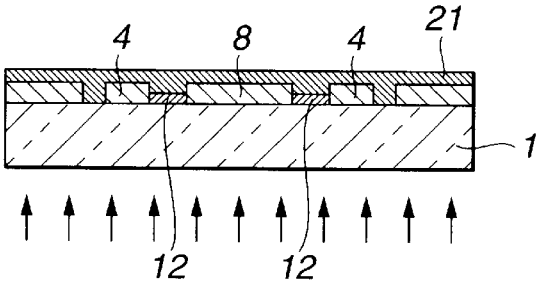
Figure 4F:
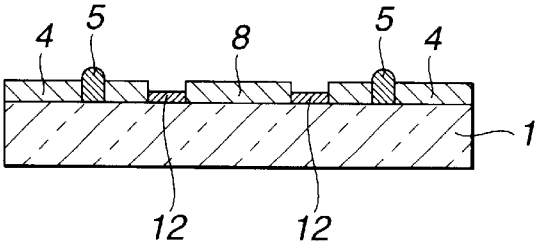

As shown in FIGS. 1 and 2, anode conductors 3 and the grid 8 are displaced at intervals and in a predetermined pattern on the inner surface of a translucent insulating substrate 1 (e.g. a glass substrate). A translucent conductive substrate, on which a transparent insulating film is formed, may be used as the substrate 1. Two columns of luminous dots are arranged in zigzag form. The gap between the anode conductor 3 and the bar of the grid 8 is about 20 $\mu$m. The anode conductors 3 and the grid 8 are formed of an aluminum thin film having the same thickness (or the height from the surface of the substrate 1). In this embodiment, the thickness ranges 1.1 $\mu$m to 1.5 $\mu$m. The opening in each anode conductor 3 is square. A fluorescent substance layer 5 is coated on the anode conductor 3 in the opening 4. The thickness of the fluorescent substance layer 5 in the opening 4 ranges 4 $\mu$m to 15 $\mu$m.

Particularly, a lightproof insulating layer 12 is formed on the substrate 1 exposed between anode conductors 3 and the grid 8. The lightproof insulating layer 12 prevents light from leaking toward the front surface of the substrate 1 through the gaps. The gaps are buried with the lightproof insulating layer while anode electrodes are being insulated from each other. The lightproof insulating material is a pigment of a composite oxide such as Cu—Mn—Fe series or Co—Fe—Cr series. In order to prevent the electron charge-up of electrons emitted from the cathode, the thickness of the lightproof insulating layer 12 is preferably smaller than that of the fluorescent substance layer 5. The fluorescent substance layer 5, which has the thickness identical to or smaller than that of an anode conductor 3 or the grid 8, can prevent the charge-up more effectively. For example, the thickness of each anode conductor 3 or the grid 8 is less than 1 $\mu$m. The lightproof insulating layer 12, as shown in FIG. 2, lies in the gaps between anode conductors 3 and bars of the grid 8 and does not cover the upper surface of them. Hence, the charge-up of the lightproof insulating layer 12 on those electrodes disturbs the electric field within the container, thus substantially not reducing the function of these electrodes.

Next, the process of manufacturing a fluorescent luminous tube of the present embodiment will be described by referring to FIGS. 3 and 4. As shown in FIG. 3(*a*), a translucent insulating (glass) substrate 1 is placed.

As shown in FIG. 3(*b*), an aluminum thin film 15 is formed on the inner surface of the glass substrate using the sputtering method.

As shown in FIG. 3(*c*), a photosensitive resist 16 is coated over the surface of an aluminum thin film 15 and then exposes ultraviolet rays via a photo mask 17. The photo mask 17 has patterns corresponding to anode conductors 3 and to the grid 8. The portions corresponding to the openings 4 and the gaps are removed off.

As shown in FIG. 3(*d*), the photosensitive resist 16 is developed to remove the exposed portions. Thus, the same patterns as those of the anode conductors 3 and the grid 8 are formed.

As shown in FIG. 3(*e*), the aluminum thin film 15 underneath the pattern (acting as a mask) of the photosensitive resist 16 is etched off. Thus, the anode conductors 3 and the grid 8, each having a predetermined pattern, are formed.

As shown in FIG. 4(*a*), a negative-type (organic artificial color series) photosensitive resist 18 is uniformly coated all over the inner surface of the substrate 1 so as to cover anode conductors 8 and the grid 18. The photosensitive resist 18, which has the function of shielding an ultraviolet rays of 400 nm or less and has an organic pigment or an organic dye, can be decomposed and removed through calcination. A photo mask 19 (where a lightproof material is at only the positions corresponding to the anode conductors 3 and the grid 4) is disposed over the inner surface of the substrate 1. The inner surface of the substrate 1 is exposed to ultraviolet rays through the photo mask 19.

As shown in FIG. 4(*b*), the exposed photosensitive resists 8 are developed and then removed. A resist pattern of shielding ultraviolet rays (an ultraviolet non-translucent organic film) is left only in the opening 4 of the anode conductor 3.

As shown in FIG. 4(*c*), a photosensitive black matrix material 20 is uniformly coated so as to cover the anode conductors 3 and the grid 8 on the surface of the substrate 1. The photosensitive black matrix material 20 is made of a photosensitive resist containing a composite oxide pigment (such as Cu—Mn—Fe series or Co—Fe—Cr) of particles of 0.5 $\mu$m or less. Ultraviolet rays are illuminated all over the outer surface the substrate 1 (by the back-surface light-exposure method). A pattern of the photosensitive resist 18 (or an ultraviolet rays non-translucent organic film), which blocks ultraviolet rays, are in the openings 4 of the anode conductors. Hence, the ultraviolet rays do not reach the photosensitive black matrix material 20 overlying the pattern but fall on the photosensitive black matrix 20 lying in the gaps between the anode conductors 3 and the grid 8. By performing a development, the photosensitive black matrix material 20 lying in the gaps between the anode conductors and the grid 8, which is exposed to the ultraviolet rays, remains.

As shown in FIG. 4(*d*), when the substrate 1 is baked at the temperature of about 500° C., the pattern of the photosensitive resist 18 (or ultraviolet rays non-translucent organic film) within the openings 4 in the anode conductors 3 are decomposed and removed. Meanwhile, the organic components of the photosensitive black matrix materials 20, which formed in the gaps between the anode conductors 3 and the grid 8 in the previous step, are decomposed and removed, so that only the pigment components of the oxide remain. Thus, lightproof insulating layers 12 are formed.

In order to prevent the charge-up of electrons, the thickness of the lightproof insulating layer is adjusted to be less than the thickness of a fluorescent substance film, preferably, less than the thickness of the anode electrode (the anode conductor 3) or the grid electrode (the grid 8), namely, 0.8 $\mu$m to 10 $\mu$m.

As shown in FIG. 4(*e*), a fluorescent substance paste 21 is coated in a predetermined thickness over the inner surface of the substrate 1 so as to cover the anode conductors 3 and the grid 8 and the lightproof insulating layer 12. Then, ultraviolet rays are illuminated all over the outer surface of the substrate 1 (using the back-surface light-exposure method). The ultraviolet rays illuminate only the fluorescent substance paste 21 within the openings 4 in the anode conductors 3 but do not fall onto the remaining fluorescent substance paste 21 formed in the previous step.

Moreover, a fluorescent substance paste 21 is coated in a predetermined thickness over the inner surface of the substrate 1 so as to cover the anode conductors 3, the grid and the lightproof film 12. Thus, this fluorescent substance paste 21 is exposed to the ultraviolet rays from the inner surface of the substrate 1 via a photo mask. The photo mask has a pattern in the portion except the pattern corresponding to the fluorescent-substance-layer formed region. The portion corresponding to the fluorescent-substance-layer formed region is removed. By using such a photo mask, ultraviolet rays may be irradiated to the fluorescent substance paste 21 which is at a desired portion including the opening 4 of an anode conductor 3. This method enables more increasing the contact area of a fluorescent substance and an anode conductor, compared with the back-surface light-exposure method. Particularly, this method is effective when a fluorescent substance of a high body resistance (e.g. a red luminous fluorescent substance such as (Zn, Cd)S:Ag, Cl or (Zn, Cd)S:Ag, Al or a red luminous fluorescent substance such as CdS:Ag, Cl or CdS:Ag, Al) is used. These two methods may be combined. Thus, the adhesion strength of a fluorescent substance to a substrate can be most strengthened.

As shown in FIG. 4(*f*), the fluorescent substance paste 12, which is coated on the lightproof insulating layer 12, is removed by performing development. Thus, only the fluorescent substance paste 21 in each opening 4 remains (because deflection of light (ultraviolet rays) results in the fluorescent substance paste on the anode conductor 3, slightly raised from the opening 4). By baking the intermediate structure, fluorescent substance layers 5 are formed. Since light exposure is performed from the outer surface of the substrate 1 in the patterning of the fluorescent substance layers 5, the fluorescent substance paste 21 begins its curing from the side thereof in contact with the substrate 1. This can provide a high adhesive strength to the substrate 1.

According to the fluorescent luminous tube with the above-mentioned structure fabricated in the above manufacturing process, light beams emitted from luminous dots pass through only the openings 4 in the anode conductors 3 and then radiate out from the substrate 1. Because the lightproof insulating layer 12 lying between the anode conductor 3 and bars of the grid 8, it van be prevented that the light leakage occurs from the gaps in the conventional structure, thus decreasing the display contrast.

Moreover, only the gaps between anode conductors 3 and bars of the grid 8 are buried with the lightproof insulating layer 12. For that reason, the method of coating a fluorescent substance paste 21 all over the surface of the substrate 1 and then exposing the outer surface of the substrate 1 to light can be employed in the step of forming a fluorescent substance layer 5 in the opening 4 of each anode conductor 3. Conventionally, because the gap between an anode conductor 3 and bars of the grid 8 is open, a mask must be accurately positioned to coat and print the fluorescent substance paste 21 in only the opening 4 without placing the fluorescent substance in the gap. However, the present invention does not require such complicated tasks.

The effect that a good display contrast and an accurate dot arrangement can be easily realized provides a great advantage when the fluorescent luminous tube of the present invention is used as an optical print head where many minute luminous dots are arranged at ultra-fine intervals.

Next, an experiment of ascertaining a light-emission-leakage reduction effect will be described below.

The substrate fabricated in the present embodiment (including the lightproof insulating layer 12 between anode conductors 3 and the grid 8) and a substrate (having the gaps between anode conductors 3 and the grid 8) used for a conventional fluorescent luminous tube are compared under the same conditions. The light power of a halogen light illuminated to the inner surface of the substrate 1 (on which anode conductors 3 and fluorescent substance layers 5 are formed) is measured on the opposite side (the outer surface) of the substrate 1 using a light power meter. The sensor sensitivity wavelength of the light power meter is set to 500 nm. As a result, the conventional substrate indicated a light power of 104.0 $\mu$W. The substrate of the present invention indicated a light power of 6.4 $\mu$W. In other words, the light transmittance of the lightproof insulating layer 12 (a black matrix) is about 6.2%, that is, less than a tenth of the light strength of leaked light.

In this embodiment, the opening 4 formed in an anode conductor 3 is square but may be circular or polygonal such as triangle or rectangular. Each anode conductor 3 has one opening 4. One large opening 4 may be formed of plural small openings defined in number-sign form.

The present invention has the following advantages.

In the frontal luminous-type fluorescent luminous tube where light is irradiated through a translucent substrate on which luminous dots are formed, the light leaked from the gaps between electrodes formed on the substrate to the front surface thereof can be shielded so that the display contrast is improved.

Moreover, only the gaps between an anode conductors and the bars of the grid are filled with a lightproof insulating layer. Hence, the method of coating a fluorescent substance paste all over the surface of a substrate and then exposing the outer surface of the substrate to light can be employed in the step of forming a fluorescent substance layer in the openings of the anode conductors. Conventionally, because the gaps between anode conductors and the bars of the grid are open, a high-precision processed mask must be accurately positioned to coat a fluorescent substance paste only in the openings, without sticking the fluorescent substance in the gaps. In contrast, the fluorescent paste must be formed only in the openings. However, the present invention can eliminate such complicated tasks.

Moreover, a fluorescent substance paste at a desired portion including the opening of an anode conductor may be light exposed from the inner surface of a substrate through a photo mask with a predetermined pattern. Compared with the conventional method of performing light exposure from the outer surface of a substrate, that approach allows the contact area of the anode conductor to the fluorescent substance to be increased. Hence, this is effective when a fluorescent substance having a high body resistance is used.

The two above-mentioned methods may be combined to more strengthen the adhesive strength of a fluorescent substance to a substrate.

Furthermore, the gaps between anode conductors and bars of the grid are buried with a lightproof insulating layer to shield light. Hence, with the opening in frame form of an anode conductor, a fluorescent substance paste on the inner surface of a substrate is thickly coated in the step of forming a fluorescent substance layer in the opening. Then, ultraviolet rays is illuminated from the outer surface of the substrate, so that the fluorescent substance paste can be patterned. In other words, the positional or geometrical precision of a fluorescent substance layer depends on that of the opening of an anode conductor of an aluminum thin film. Hence, the luminous portions (luminous dots) can be arranged with high precision. This can realize an optical print head with high resolution in simplified steps.

As described above, to pattern a fluorescent substance layer, the present invention can employ the step of illuminating light from the outer surface (rear surface) of a substrate using anode conductors or the grid as a mask. Hence, even materials having a ultraviolet absorption region and a patterning-resistant property, such as (Zn, Cd) S:Ag, Cl, (Zn, Cd) S:Ag, Al, CdS:Ag, Al, or CdS:Ag, Cl, can be used because the adhesive property to the substrate is increased by the back surface exposure.

The residue of a fluorescent substance adhered at the position displaced from the opening of an anode conductor or to the grid (particularly, on the side surfaces of the electrodes) in the manufacturing process, causes spot light in the drive operation of a fluorescent luminous tube. Conventionally, the gap between an anode conductor and bars of a grid being in an open state causes the spot light leaked from the outer surface (rear surface) of a substrate. For example, when the fluorescent luminous tube is used as an optical print head which records an image on a photographic paper, fogging of unnecessary light causes on the photographic paper, thus deteriorating the image quality. However, the present invention can eliminate the fogging of unnecessary light, thus improving the image quality.

Moreover, thinning the thickness of a lightproof insulating layer than that of the fluorescent substance layer enables quickly avoiding the possible charge-up of electrons on the lightproof insulating layer. More preferably, by making the thickness of the lightproof insulating layer smaller than the thickness of the anode conductor or the grid, the charge-up can be reduced.

What is claimed is:

1. A fluorescent luminous tube, comprising:

anode conductors and bars of a grid, each being arranged over an inner surface of a translucent substrate and spaced apart from one another, said anode conductors each having an opening which exposes said substrate;

a fluorescent substance layer formed in said opening;

a housing for sealing said inner surface of said substrate;

an electron source disposed inside said housing; and a lightproof insulating layer formed in the gap between each anode conductor and each bar of said grid.

2. A fluorescent luminous tube, comprising:

a translucent substrate;

a plurality of anode conductors arranged over an inner surface of said substrate at predetermined intervals, each of said anode conductors having an opening which exposes said substrate;

a fluorescent substance layer formed in said opening;

a grid arranged over the inner surface of said substrate, bars of said grid being disposed between said anode conductors and spaced apart from said anode conductors;

a housing for sealing said inner surface of said substrate;

an electron source disposed inside said housing;

a plurality of luminous dots where luminous substance layers each defined by said opening are arranged at said predetermined intervals, viewed from the outer surface of said substrate; and a lightproof insulating layer formed on the inner surface of said substrate so as to bury the gap between each anode conductor and each bar of said grid.

3. The fluorescent luminous tube defined in claim 1 or 2, wherein the thickness of said lightproof insulating layer does not exceed the thickness of a fluorescent substance layer.

4. The fluorescent luminous tube defined in claim 1 or 2, wherein light emission of said fluorescent substance layer, which results from impingement of electrons emitted from said electron source, is observed from the side of said substrate via said opening and said substrate, or wherein light emission of each luminous dot, which results from impingement of electrons emitted from said electron source, is illuminated out from said substrate via said opening and said substrate.

5. A method of manufacturing a fluorescent luminous tube, comprising the steps of:

forming a plurality of anode conductors on an inner surface of a translucent substrate at intervals, each of said plurality of anode conductors having an opening which exposes said substrate;

coating a photosensitive resist all over the inner surface of said substrate and then light-exposing said photosensitive resist via a mask, said mask being disposed so as to confront the inner surface of said substrate, whereby a lightproof film is formed only the inside of said opening;

coating a photosensitive lightproof fluorescent insulating material all over the inner surface of said substrate, light-exposing the entire outer surface of said substrate, and removing said lightproof film in said opening, while forming a lightproof insulating film only on said substrate between said anode conductors; and coating a photosensitive fluorescent substance from the inner surface of said substrate to at least said opening, light-exposing said substrate, and then forming a fluorescent substance layer.

6. The method defined in claim 5, further comprising the steps:

light-exposing all over the outer surface of said substrate; and then forming a fluorescent substance layer in said opening.

7. The method defined in claim 5, further comprising the steps of:

light-exposing the inner surface of said substrate from the inner surface via a mask, said mask being disposed so as to confront the inner surface of said substrate; and then forming a fluorescent substance in said opening.

8. The method defined in claim 5, further comprising the steps of:

performing light-exposure all over the outer surface of said substrate while performing light-exposure from the inner surface via a mask, said mask being disposed so as to confront the inner surface of said substrate; and then forming a fluorescent substance in said opening.

* * * * *